US007976244B2

(12) United States Patent
Keating

(10) Patent No.: US 7,976,244 B2
(45) Date of Patent: Jul. 12, 2011

(54) METHOD AND SYSTEM FOR CONSTRUCTING AND INSTALLING DOCKS

(76) Inventor: Joseph W. Keating, Johns Island, SC (US)

( * ) Notice: Subject to any disclaimer, the term of this patent is extended or adjusted under 35 U.S.C. 154(b) by 345 days.

(21) Appl. No.: 12/052,711

(22) Filed: Mar. 20, 2008

(65) Prior Publication Data

US 2008/0298900 A1 Dec. 4, 2008

Related U.S. Application Data

(60) Provisional application No. 60/895,781, filed on Mar. 20, 2007.

(51) Int. Cl.
*E04G 3/30* (2006.01)

(52) U.S. Cl. ..... 405/223; 405/218; 182/142

(58) Field of Classification Search ..... 405/218, 405/221–223; 182/82, 142, 145; 114/263–265
See application file for complete search history.

(56) References Cited

U.S. PATENT DOCUMENTS

| | | | | | |
|---|---|---|---|---|---|
| 2,564,123 | A * | 8/1951 | Melges et al. | 405/221 |
| 2,598,730 | A | 6/1952 | Thompson et al. | |
| 2,909,900 | A * | 10/1959 | Suderow | 405/196 |
| 3,043,109 | A * | 7/1962 | Erickson | 405/220 |
| 3,074,239 | A * | 1/1963 | Mustard | 405/221 |
| 3,511,057 | A * | 5/1970 | Bruno | 405/196 |
| 3,572,045 | A * | 3/1971 | Owen | 405/212 |
| 3,608,670 | A * | 9/1971 | Blake et al. | 182/2.6 |
| 3,614,871 | A | 10/1971 | Nordell | |
| 3,999,397 | A * | 12/1976 | Albery | 405/218 |
| 4,008,506 | A * | 2/1977 | Smith | 14/71.1 |
| 4,050,257 | A * | 9/1977 | Parks et al. | 405/218 |
| 4,583,618 | A | 4/1986 | Zimmerman | |
| 4,589,800 | A * | 5/1986 | Nasby, Jr. | 405/221 |
| 4,645,380 | A | 2/1987 | Hambrick et al. | |
| 4,804,298 | A * | 2/1989 | Nasby, Jr. | 405/218 |
| 4,890,959 | A * | 1/1990 | Robishaw et al. | 405/204 |
| 4,948,300 | A | 8/1990 | Bateson | |
| 6,128,880 | A * | 10/2000 | Meenan, Jr. | 52/489.1 |
| 6,364,574 | B1 * | 4/2002 | Khachaturian | 405/204 |
| 6,558,083 | B1 | 5/2003 | Quandt | |
| 6,695,541 | B1 | 2/2004 | Spence | |
| 6,746,181 | B1 | 6/2004 | Heintz et al. | |
| 7,011,036 | B1 * | 3/2006 | Hill | 114/362 |
| 7,124,700 | B1 * | 10/2006 | Impey | 114/263 |
| 7,128,015 | B1 * | 10/2006 | Rogerson | 114/266 |
| 7,144,199 | B2 * | 12/2006 | Bontje | 405/218 |
| 7,213,526 | B1 * | 5/2007 | Hamilton | 114/44 |
| 7,241,078 | B2 * | 7/2007 | Surges | 405/220 |
| 7,353,769 | B2 * | 4/2008 | Unrast et al. | 114/361 |
| 2003/0127287 | A1 | 7/2003 | Apostolopoulos | |
| 2006/0045629 | A1 * | 3/2006 | Bontje | 405/218 |

* cited by examiner

*Primary Examiner* — Tara Mayo-Pinnock

(57) ABSTRACT

Disclosed is a system and method for installing docks. The system comprises a scaffold portion having at least a first end and a second end. The first end is adapted to be removably secured to a first dock portion. The second end of the scaffold portion has a template thereon adapted for positioning pilings of a second dock portion to be installed. The scaffold includes a support structure upon which a dock builder stands during installation of the second dock portion. The method comprises installing a first dock portion, removably securing a first end of a scaffold portion of a dock installation system to the first dock portion, lowering a second end of the scaffold portion such that the first end of the scaffold portion is cantilevered at the first dock portion, using a template on a second end of the scaffold portion to arrange and position one or more components of a second dock portion to be installed, and installing the second dock portion.

14 Claims, 4 Drawing Sheets

METHOD AND SYSTEM FOR CONSTRUCTING AND INSTALLING DOCKS

CROSS-REFERENCE TO RELATED APPLICATIONS

This application claims the benefit of the filing date of a nonprovisional patent application entitled "METHODS AND APPARATUSES FOR BUILDING DOCKS", filed on Mar. 20, 2007, having application Ser. No. 60/895,781, which is incorporated herein by reference in its entirety.

TECHNICAL FIELD OF THE INVENTION

The invention relates to dock building. More particularly, the invention relates to a method and system for use in dock construction and installation that avoid or minimize damage to the surrounding environment while reducing construction time and costs.

BACKGROUND OF THE INVENTION

The conventional process used to build and install a dock is typically as follows. The first step is to establish the center of the walkway at the edge of the shore. The second step is to establish the center of the walkway at the rivers edge. Generally, this is accomplished by placing a pipe or stake at the river's edge that will be visible from the shore. Then, construction of the batter boards is performed (batter boards are a temporary bench, constructed to define the width of the walkway pilings) at both the shore's edge and at a point approximately one hundred feet from shore. Two strings of equal length are stretched on each side of the batter boards to ensure that the batter boards are positioned parallel to one another. Next, a mark is made on each string at eight feet, ten feet, or twelve feet depending on the choice of piling distance. This is typically done with a magic marker. Two pilings are then carried out to the first marked point nearest the shore and place in the ground. Generally, this is either done by digging a posthole where the ground is solid or jetting the pilings down and driving them into place with a heavy hammer. All subsequent pairs of pilings are progressively placed in a similar manner at the predetermined spacing until the one hundred foot length is attained.

After all the pilings have been installed, walkways are built over non-navigable marshes and mud flats until the walkways reach the navigable waters edge. Water is an inevitable nuisance when constructing the walkways during time periods from middle to high tide. Even so, for longer walkways, it is customary to transport pilings while the water is at a higher level so that they can be tethered with a stake in the mud where the interval marks were previously made on the strings. Alternatively, when the tide is out, dock builders will simply walk to the predetermined interval marks and erect the pilings accordingly. Once all the pilings are set, a board, also known as a bench, is nailed to each pair of pilings.

After about a 100 feet of pilings are in place, scaffold boards are erected on top of the benches. Once this phase of the construction and installation process is completed, the dock builders can walk from one set of pilings to the other without getting in the water or mud. The dock builders can easily walk the scaffold boards to jet the pilings deeper, if needed, or hammer them into place. The pilings, however, are usually not plumbed at this time. Normally, the pilings are plumbed later via a come-a-long or winch and then set by nailing permanent cross braces in place. To complete the process of setting 100 feet of pilings, it can take up to two days for a team of four experienced dock builders.

The next step in the traditional process of dock building requires that permanent cross benches be installed with the use of a transit to insure level placement. Three floor joists (normally 2×8) can then be installed on top of the benches. After that, 1×6 decking is temporarily laid on top of the joists. The top of the pilings usually rise above the 2×8 floor joists and, therefore, are cut below the top joist at this time. Often, a string is extended from the edge of the previously built deck (or the batter board if the overall length is less than 100 feet), to facilitate the installation of the deck boards in a perfectly straight line. This phase of the process to install the joists and decking routinely takes a team of four dock builders a day to complete.

On average, a 100-foot walkway takes four days to build from start to finish. For docks extending over 250 feet, the timing of the tide and cold weather conditions can further slow the construction to five or six days per 100 feet. Further, due to the repeated back and forth traffic of the dock builders, it can be expected that this traditional, inefficient method of construction and installation will result in the destruction of the delicate, and often legally protected, marsh environment on either side of the walkway. It is not uncommon for the environment to take between five and ten years to recuperate from the damage.

Thus, a need exists for a method and system for the constructing and installing docks that avoid, or at least minimize, potential damage to the environmentally delicate marsh and shore. A need also exists for a method and system that make dock and walkway construction more efficient in terms of time, labor, and costs.

SUMMARY OF THE INVENTION

The invention is directed to a system and method for installing docks. The system comprises scaffold portion having at least a first end and a second end. The first end is adapted to be removably secured to a first dock portion. The second end of the scaffold portion has a template thereon adapted for positioning pilings of a second dock portion to be installed. The scaffold includes a support structure upon which a dock builder stands during installation of the second dock portion.

The method comprises installing a first dock portion, removably securing a first end of a scaffold portion of a dock installation system to the first dock portion, lowering a second end of the scaffold portion such that the first end of the scaffold portion is cantilevered at the first dock portion, using a template on a second end of the scaffold portion to arrange and position one or more components of a second dock portion to be installed, and installing the second dock portion.

Other features and advantages of the invention will become apparent from the following description, drawings and claims.

DETAILED DESCRIPTION OF THE INVENTION

In accordance with the invention, a system is provided that comprises a scaffold cantilever adjustable frame construction and alignment tool (SCAFCAT) that can be used to build and install docks in a manner that prevents, or at least lessens, damage to the shore, shore bottom and surrounding marsh adjacent to an area in which a dock is to be installed.

Figure 1:
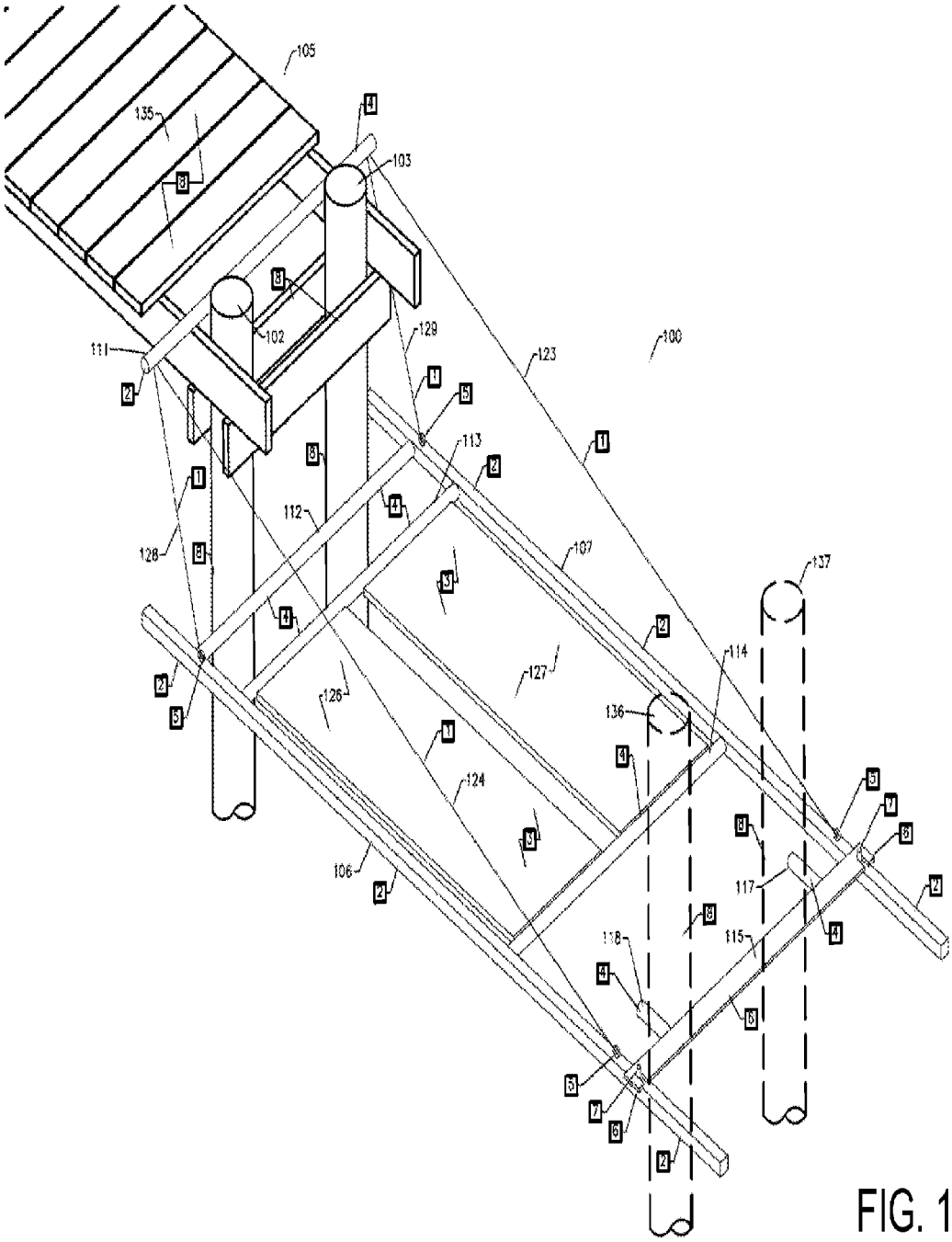
FIG. 1 illustrates a perspective view of an illustrative embodiment of the system of the present invention in an installed, and ready to use, position.

Referring now to the drawings, exemplary embodiments, aspects and features of the present invention will be described. FIG. 1 illustrates a perspective view of the SCAFCAT system 100 in accordance with an illustrative embodiment of the invention. The system 100 couples on one of its ends to two pilings 102 and 103 of a portion of the dock 105 that has already been built using the system 100. The system 100 comprises two parallel side members 106 and 107, a plurality of lateral members 111-118, cables 123 and 124, and two removable scaffold boards 126 and 127.

As with the conventional method for building a dock, construction of a dock with the system 100 typically starts by establishing the center point of the proposed walkway at the edge of the shore. Next, the center point of the walkway at the rivers edge is determined. Once the aforementioned two points are set, a transit is installed at the shoreline. An imaginary line that extends between these two center points is the centerline of the walkway. Unlike the traditional method, however, no batter boards are required for building a dock when using the system 100. The first two pilings (not shown in the figures) are placed equidistantly from the centerline of the walkway. Generally, other than the system 100, nothing else is needed to install the next two pilings.

Using the transit and a four-foot level, the second two pilings 102 and 103 are installed at equal distances from the centerline of the walkway. These pilings 102 and 103 will be left to extend above the eventual plane of the floor joists. Next, the benches 101 are installed using the transit to level them. Finally, floor joists 104 and walk treads 108 are installed with the installation of the last couple of treads adjacent to the pilings 102 and 103 deferred until a later time. With the initial section of the dock 105 completed, the system 100 can now be used to construct the remaining sections of the dock with minimal disruption of the surrounding environment.

In the preferred embodiment, the system 100 attaches to the last two pilings installed 102 and 103, i.e., to the most recently installed pilings. Once securely in place, the system 100 preferably hangs down about thirty-two inches below the plane of the walkway. Currently, all docks and walkways, by law, must be at least thirty-six inches above high tide level. In accordance with this embodiment, because the system 100 only hangs down thirty-two inches, work can be done at any tide level. After the first four pilings are in place, the walkway 135 should be sufficiently anchored to support the outward force created by the use of the system 100. With the lateral member 112 acting as a pivot point, the system 100 creates a moment arm that is applied to the upper portion of the pilings via lateral member 111. Naturally, for the system 100 to be employed safely, the existing portion of the walkway 135 must be sufficiently rigid to accommodate the cantilever effect of the system 100. If the contractor determines that the existing length of the walkway is not stable enough to support use of the system 100, he may have to better anchor the first pilings.

The lateral member 111, which is typically a length of pipe or solid stock, is positioned behind the last two pilings 102 and 103 and abuts the floor joists 104. Two cables, chains, or solid steel connectors 128 and 129 extend down from each end of the lateral member 111, thereby securing the back portion of the scaffold frame to the existing portion of the dock 105. Two other cables, chains or solid steel connectors 123 and 124 extend from the lateral member 111 to the far ends of the scaffold frame of the system 100, with a turnbuckle connecting the connectors 123 and 124 to the scaffold frame. When using the scaffold frame, two dock builders first place the lateral member 111 on the inside edge of the pilings 102 and 103 and then stand the scaffold frame up. Next, the dock builders lower the scaffold frame of the system 100 along the outside edge of the pilings 102 and 103 such that lateral pivot member 112 stays proximate to the surface of the pilings 102 and 103 and the first two connectors 123 and 124 become taut. The scaffold frame is now generally vertical and suspended by connectors 123 and 124 and can be lowered much like a drawbridge until the second two connectors 128 and 129 are taut. At this point in time, the system 100 is securely in place and a dock builder can climb down and stand on the edges (members 106 or 107) of the scaffold frame in order to place the two removable scaffold boards 126 and 127 on the scaffold board supports of the system 100. The next step in the procedure is to align the system 100.

The template defined by the members 115, 117 and 118 is placed over the end studs 136 and 137 that are premeasured at, for example, eight, ten, or twelve feet. Using the transit and placing a four-foot level in the middle of the premarked template, one of the builders can adjust the turnbuckles until the middle of the template is aligned with the centerline of the walkway. The system 100 may need to be adjusted occasionally when wooden pilings are being used because the pilings tend to be different in size. If the diameters of the pilings vary such that it is difficult to consistently align the system 100, wedges (not shown) can be driven behind the lateral pivot member 112 to provide greater stability.

Once the system 100 is secured and aligned, the next pair of pilings to be installed can be carried down the finished portion of the walkway by two dock builders while a third dock builder stands on the scaffold boards 126 and 127. The two dock builders carrying the pilings then hand the piling to the third builder. The installation process may be carried out by as few as a single builder, but using two or three builders further expedites the process. While one of the two dock builders standing on the finished walkway holds one end of a piling, the third builder standing on the scaffold boards 126 and 127 holds the other end of the piling while the second builder standing on the finished walkway climbs down onto the scaffold boards 126 and 127 to take the first end of the piling from the first builder. Now, the second and third builders can proceed to place the piling at the edge of the template defined by the members 115, 117 and 118, erect the piling to a vertical position, and then lower it into place. Once both pilings 136 and 137 are in position, each can be jetted down and hammered into place by conventional means. The pilings 136 and 137 will not need to be re-plumbed, as the template defined by the members 115, 117 and 118 guarantees proper and plumb positioning of the pilings while the cross bracing is permanently affixed and cut flush with the outside of the pilings 136 and 137.

The permanent benches are installed by using the transit to ensure that they are parallel and on plane with the benches 101 installed on the previous set of pilings 103 and 104. Next, the template defined by the members 115, 117 and 118 is removed, followed by removal of the scaffold boards 126 and 127 and the other portions of the system 100. The system 100, when built with chains or cables 123, 124, 128, 129, will lay flat on the completed walkway. A scaffold board (not shown) can be extended from the walkway to the new bench and used to help install the floor joists that need to extend from the previously installed set of pilings 102 and 103 to the newly installed set 136 and 137. Once the dock builders have installed the aforementioned joists, the previous pilings 102 and 103 can be cut below the top level of the floor joists in anticipation of deck boards being installed permanently over them.

With the SCAFCAT 100 and its method of use, fifty feet of walkway can be aligned and constructed with only three men. For each day (e.g., eight-hour days) after the first day, three workers skilled in the use of system 100 will be able to construct at least eighty feet of walkway without regard to tide level. Other than on the first day, when the first section of a dock is constructed, no dock builder will ever have need to walk in the marsh if the system 100 is employed. As a result, only very minimal damage to the environment immediately along the shoreline may occur.

Figure 2:
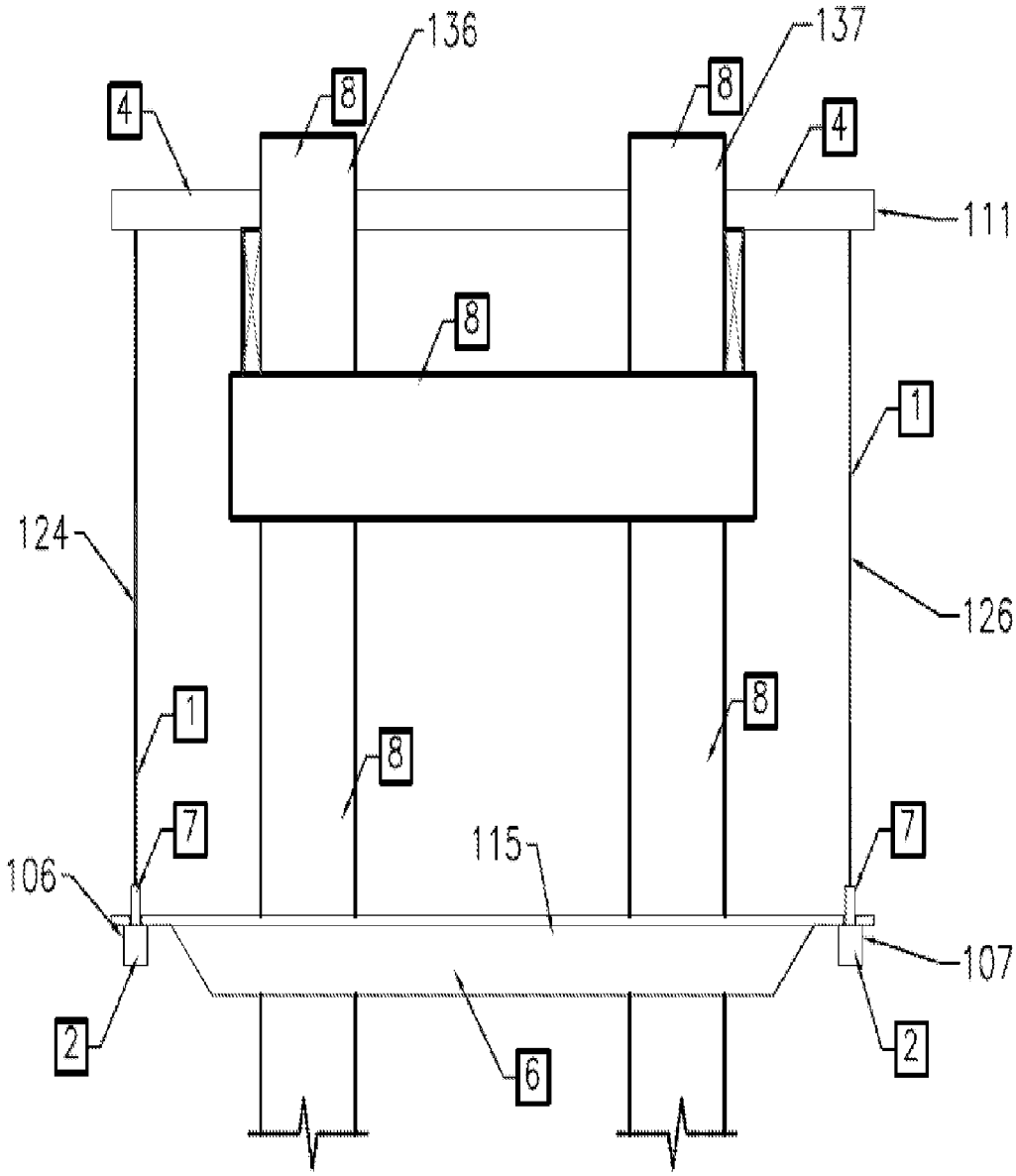
FIG. 2 illustrates a frontal view of the system shown in FIG. 1 in an installed, and ready to use, position.
Figure 3:
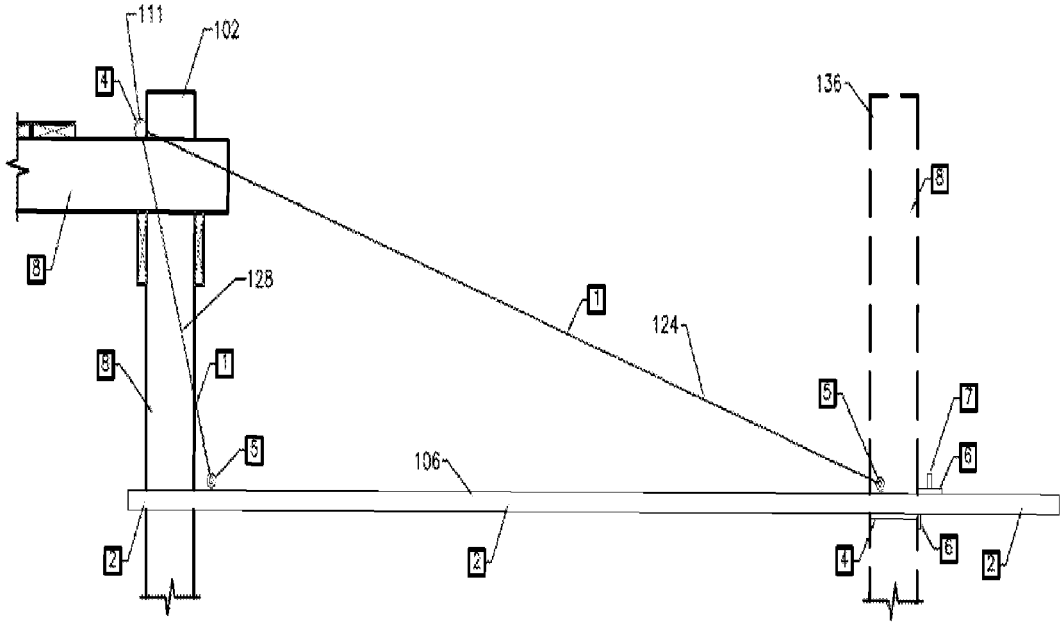
FIG. 3 illustrates a side view of the system shown in FIG. 1 in an installed, and ready to use, position.
Figure 4:
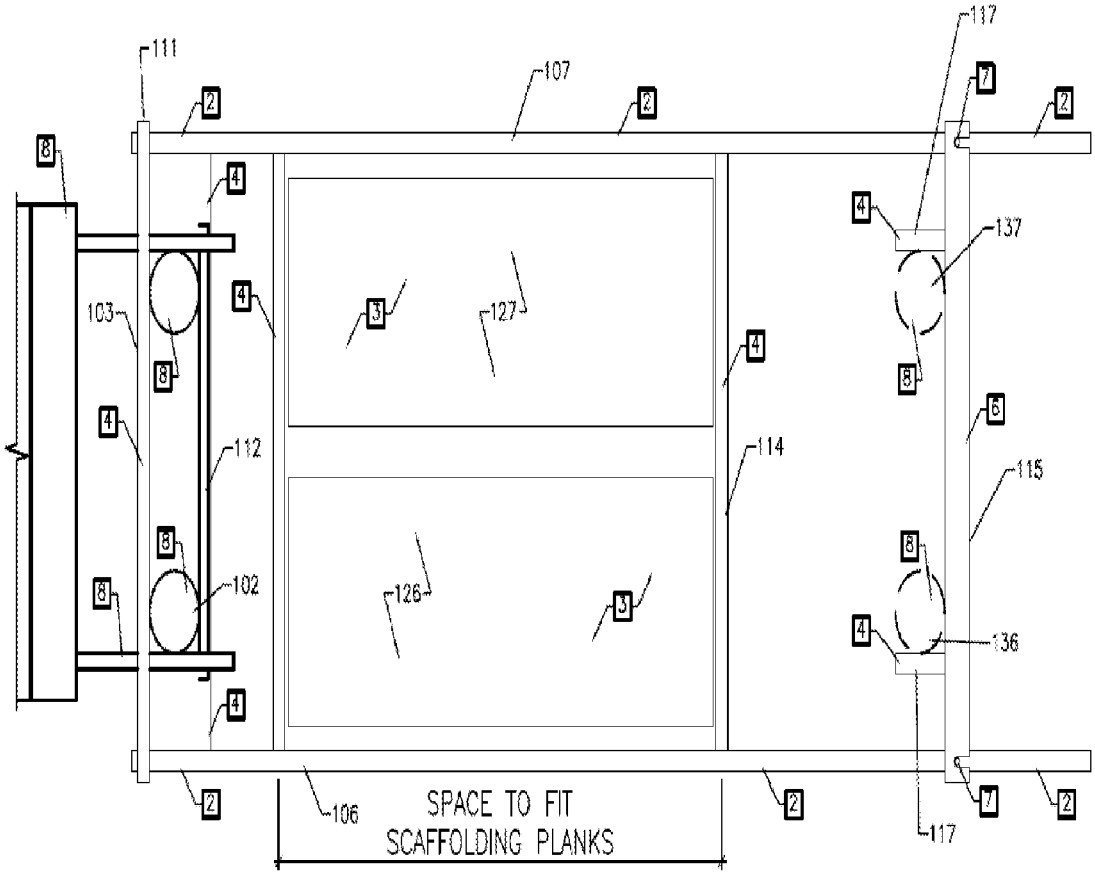
FIG. 4 illustrates a top view of the system shown in FIG. 1 in an installed, and ready to use, position.

FIG. 2 illustrates a front view of the system 100 coupled on an end to the outermost pilings 136 and 137. In this view, the system 100 is shown securely in place and ready to be aligned and used to build the next section of dock. FIG. 3 illustrates a side view of the system 100 whereas FIG. 4 illustrates a top view of the system 100. It should be noted that although the system 100 has been described as having a template intended for the installation of pilings located inside the planes of the floor joists, the template defined by the members 115, 117 and 118 could instead be designed for the installation of pilings placed outside the plane of the joists. Persons of ordinary skill in the art will understand the manner in which these and other changes may be made to the system 100.

It should be noted that the invention has been described with reference to a few illustrative embodiments for the purpose of demonstrating the principles and concepts of the invention. Also, although the system 100 and method have been described with reference to dock construction and installation, the system 100 and method are suitable for use in constructing other types of structures, such as, for example, walkways and platforms. Those of ordinary skill in the art will understand, in view of the description being provided herein, that many modifications may be made to the embodiments described herein and that all such modifications are within the scope of the invention.

What is claimed is:

1. A system configured to facilitate the installation of a second dock portion adjacent to a previously installed first dock portion, the system comprising:

a scaffold portion comprising at least a first end, a second end, and a support structure suitable for a dock builder to stand upon during installation of a second dock portion, wherein:

the first end is configured to be removably secured to a previously installed first dock portion; and the second end comprises a template thereon adapted for positioning of pilings of a second dock portion to be installed adjacent to said previously installed first dock portion;

wherein no component comprised within said scaffold portion is a dock portion component.

2. The system of claim 1, wherein the system further comprises:

a cantilever arrangement that cantilevers the scaffold portion to the first dock portion.

3. Then system of claim 2, wherein the cantilever arrangement includes a plurality of support members and connectors that cooperate to provide a cantilever effect when the first end of the scaffold portion is removably secured to the first dock portion.

4. The system of claim 3, wherein the system is adjustable to allow the template to be accurately positioned.

5. The system of claim 3, wherein the connectors include one or more cables or chains that couple one or more members of the cantilever arrangement to one or more other members of the cantilever arrangement.

6. The system of claim 5, wherein said one or more members of the cantilever arrangement include at least a first member that braces against a first side of the first dock portion and a second member that braces against a second side of the first dock portion.

7. The system of claim 6, wherein the first and second members are coupled to said one or more cables or chains to allow the scaffold portion to be raised and lowered relative to the first dock portion.

8. A system configured to facilitate the installation of a second dock portion adjacent to a previously installed first dock portion, the system comprising:

a scaffold portion comprising at least a first end, a second end, and a support structure suitable for a dock builder to stand upon during installation of a second dock portion, wherein:

the first end is configured to be removably secured to a previously installed first dock portion; and the second end comprises a template thereon adapted for positioning of pilings of a second dock portion to be installed adjacent to said previously installed first dock portion; and a cantilever arrangement that is configured to cantilever the scaffold portion to the previously installed first dock portion, wherein the cantilever arrangement includes a plurality of support members and connectors that cooperate to provide a cantilever effect when the first end of the scaffold portion is removably secured to the previously installed first dock portion;

wherein no component comprised within said scaffold portion or said cantilever arrangement is a dock portion component;

Wherein the scaffolding and the dock are independent elements and, upon completion of dock construction, the scaffolding is completely removed.

9. A method for installing a dock comprising:

installing a first dock portion;

removably securing a first end of a scaffold portion of a dock installation system to the first dock portion, wherein the scaffold portion comprises a support structure suitable for a dock builder to stand upon during installation of a second dock portion;

lowering a second end of the scaffold portion such that the first end of the scaffold portion is cantilevered at the first dock portion;

using a template on the second end of the scaffold portion to arrange and position one or more components of a second dock portion to be installed, wherein the one or more components comprise a piling;

installing a second dock portion, wherein the second dock portion is installed subsequent to positioning the one or more components of the second dock portion; and removing the scaffold portion from the first dock portion, wherein the scaffolding and the second dock portion are independent elements and, upon completing construction of the second dock portion, the scaffolding is completely removed.

10. The method of claim 9, wherein the dock installation system further comprises:

a cantilever arrangement that cantilevers the scaffold portion to the first dock portion.

11. Then method of claim 10, wherein the cantilever arrangement includes a plurality of support members and connectors that cooperate to provide a cantilever effect when the first end of the scaffold portion is removably secured to the first dock portion.

12. The method of claim 11, wherein the system is adjustable to allow the template to be accurately positioned.

13. The method of claim 11, wherein the connectors include one or more cables or chains that couple one or more members of the cantilever arrangement to one or more other members of the cantilever arrangement.

14. The method of claim 13, wherein said one or more members of the cantilever arrangement include at least a first member that braces against a first side of the first dock portion and a second member that braces against a second side of the first dock portion.

* * * * *